United States Patent [19]

Dionne

[11] Patent Number: 4,912,366

[45] Date of Patent: Mar. 27, 1990

[54] COAXIAL TRAVELING WAVE TUBE AMPLIFIER

[75] Inventor: Norman J. Dionne, Arlington, Mass.

[73] Assignee: Raytheon Company, Lexington, Mass.

[21] Appl. No.: 129,260

[22] Filed: Dec. 7, 1987

[51] Int. Cl.[4] ..... H01J 25/34

[52] U.S. Cl. ..... 315/3.5; 315/3.6; 315/5.31

[58] Field of Search ..... 315/3.5, 5.35, 3.6, 315/5.31, 39.3; 335/210; 333/163

[56] References Cited

U.S. PATENT DOCUMENTS

| | | | |
|---|---|---|---|
| 2,811,663 | 10/1957 | Brewer et al. | 315/5.31 |
| 2,885,593 | 5/1959 | Cook | 333/163 |
| 3,654,565 | 4/1972 | Jasper, Jr. | 315/3.6 |
| 4,282,457 | 8/1981 | Harper | 315/3.6 |
| 4,559,474 | 12/1985 | Duret et al. | 315/3.5 |

*Primary Examiner*—Theodore M. Blum

*Attorney, Agent, or Firm*—Denis G. Maloney; Richard M. Sharkansky

[57] ABSTRACT

A coaxial TWT comprises a hollow beam gun which injects a thin annular beam between multifilar helices independently supported by thin-walled dielectric sleeves. The beam is focussed by a balanced, coaxial PPM focussing assembly, causing a stable hollow beam flow. The input and output coupling helixes, and the interaction helices which form the slow-wave structure on the exterior and the interior of the hollow beam, respectively, are preferably counterwound with respect to each other to provide greater frequency bandwidth than when similarly wound. Input and output helix coupling to either the inner or the outer helix is possible.

13 Claims, 2 Drawing Sheets

COAXIAL TRAVELING WAVE TUBE AMPLIFIER

BACKGROUND OF THE INVENTION

The problems of extending helix-type TWT's to high frequencies at high average power levels involve limitations of thermal dissipation and the small size and cost of delay line fabrication.

Conventional PPM-focussed TWT's of the helix type for wide-band operation are believed to be impractical for use above 50 GHz because of the difficulty and cost in fabricating parts of very small dimension. Engineering materials available for those devices have practical limits to the thermal dissipation densities in removing Joule heating of the helix structure, normally support by dielectric rods, in order to minimize circuit dispersion and to maintain broad band characteristics. The upper limit to power levels of operation is observed to decrease inversely as the five-halves power of frequency.

A number of alternative interaction structures have been developed for increased frequency and power performance. However, those non-helix-based structures are intrinsically bandwidth limiting. For example, linear beam interaction structures employing coupled cavities, folded waveguides, fast wave guides, helical waveguides, and carp lines eliminate the need for a dielectric support structure for much improved thermal dissipation. But, these circuits have not demonstrated the bandwidth properties of the conventional helix circuit in practical devices.

To circumvent the preceding difficulties, the TWT of this invention has a coaxial helix structure which interacts with a coaxial periodic-permanent-magnet(PPM)-focussed hollow beam. Analysis indicates that substantial power (hundreds of watts) is available from the coaxial TWT (CTWT) at frequencies above 100 GHz at substantial bandwidth (40% or better).

In the CTWT device of this invention, the problem of thermal dissipation limitations is avoided by employing a coaxial multifilar (10 to 40 wire starts per turn), contrawound helix structure having a greatly increased radius of cross section; this system of helices may be photolithographically deposited upon thin-walled dielectric tubing, typically quartz, providing an efficient thermal contact for heat dissipation as well as part of a vacuum envelope for the hollow beam. RF power dissipation densities are reduced inversely as the median radius of the helix system.

The low dispersive properties of the coaxial helix structure are achieved by means of the heavy back wall loading afforded by the metallic conductive layer bonded to the exterior surfaces of the dielectric tubing. Frequency extension of the helix system is a result of a property of the multifilar helix whereby the space harmonic structure in the Brillouin zones are extended in phase space ($\beta$ in an $\omega-\beta$ diagram) in direct proportion to the number of helix tapes ("wires") encountered per turn (wire starts per circumferential revolution). Expressed in terms of the helix pitch, p, and the axial propagation constant, $\beta$, the first Brillouin zone defined by $\beta p/2\lambda$ is increased to a value N $\beta p/2\lambda$ where N is the number of wires per turn of the multifilar helices. Typical values of N for a 35 GHz circuit having a median helix diameter of 6 mm would be on the order of 30 for a 10 kV circuit structure in order to maintain the predominance of the fundamental spatial harmonic and to avoid backward wave oscillation difficulties.

A feature of this invention is that the space charge potential within a radial cross-section of the beam is small, typically less than 10 volts, and is a result of having the beam confined between the inner and outer multifilar helical coils forming the coupled slow-wave circuits. The low space charge potential allows focussing of the beam by a PPM structure whose required magnetic field is substantially smaller than is required for a single helix TWT whose space charge potential within a radial cross-section of the beam is one or two orders of magnitude larger.

SUMMARY OF THE INVENTION

The coaxial TWT of this invention comprises a hollow beam gun which injects a thin annular beam between multifilar helices independently supported by thin-walled dielectric sleeves. The beam is focussed by an inner and outer balanced, coaxial PPM focussing assembly 21, 22, causing a stable hollow beam flow. Radial restoring forces, approximately proportional to the square of the radial displacement from median radius, contain the beam in a manner similar to that for conventional solid beams. The input and output coupling helixes 35, 37, and the interaction helices 39, 32 which form the slow-wave structure on the exterior and the interior of the hollow beam, respectively are preferably counterwound with respect to each other to provide greater frequency bandwidth than when similarly wound. Input and output helix coupling to either the inner or the outer multifilar helix is possible. Increased operating efficiency is obtained by collecting the hollow electron beam by depressed collector elements.

BRIEF DESCRIPTION OF THE DRAWINGS

The aforementioned aspects and other features, objects, and advantages of the apparatus according to the present invention will be apparent from the following description taken in conjunction with the accompanying drawings wherein.

DESCRIPTION OF THE PREFERRED EMBODIMENT

Figure 1:
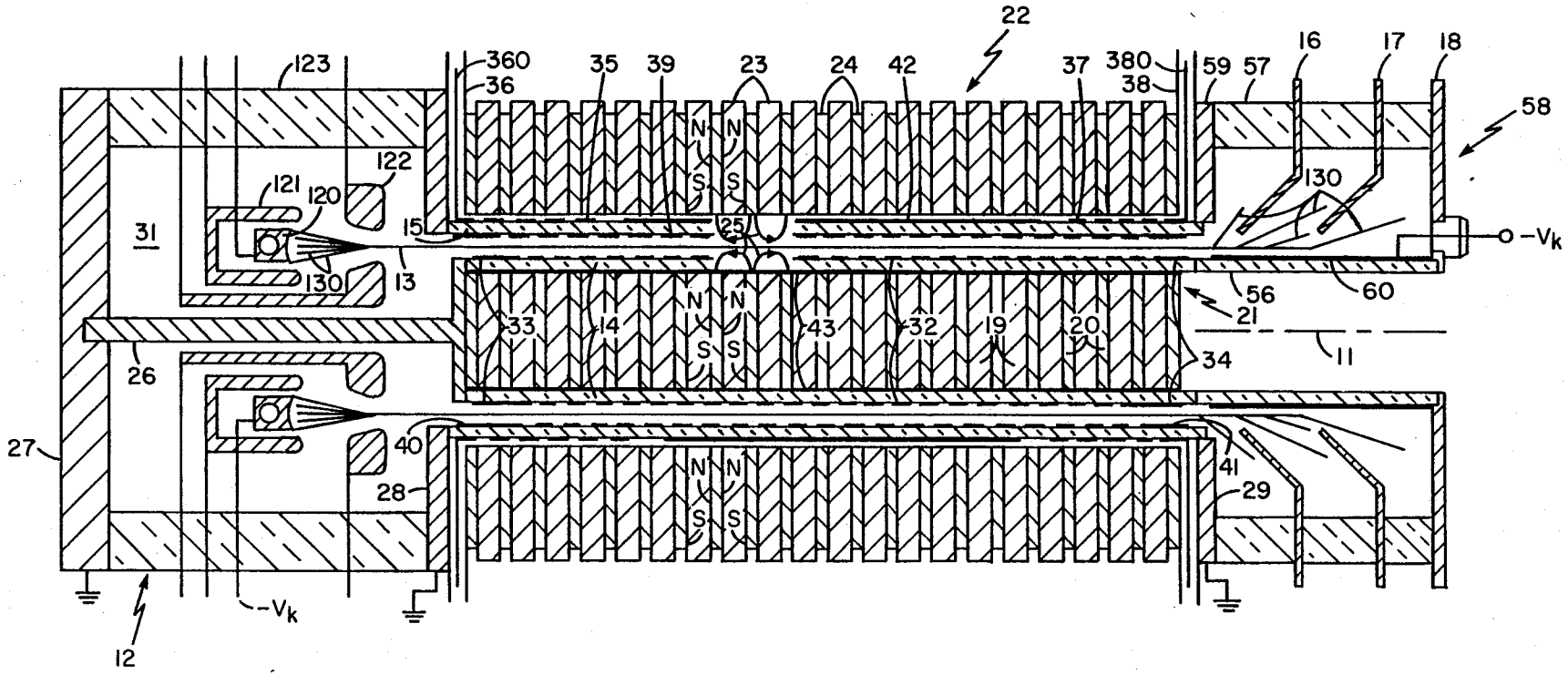
FIG. 1 is a longitudinal view in cross-section of the coaxial TWT of this invention.

Referring to FIG. 1, there is shown a longitudinal cross-sectional view through the axis of circular symmetry 11 of the coaxial traveling wave tube (CTWT) 10. The CTWT 10 comprises a hollow beam electron beam gun 12 which produces an electron beam 13 coaxial with the axis 11. The beam travels down the length of the CTWT between two cylindrical quartz tubes 14, 15 which are as close to the electron beam as reasonably feasible without intercepting the beam. After traveling down the length of the CTWT, the hollow electron beam 13 impacts upon depressed collector 58 elements 16, 17 and 18, each of which may be at different negative potentials with respect to ground and each of which intercept a fraction of the total electron beam 13 thereby reducing the required power level supplied to the device. The collector electrode 59 is maintained at ground potential while the electrodes 16, 17, 18 and the resistive coating 60 are maintained at successively more negative potentials up to the cathode potential, $-V_k$, with respect to ground. Another object of the design of the depressed collector elements is to cause the thin focussed hollow electron beam 13 to become defocussed and impact upon an extended area of electrodes with minimal thermal dissipation. Resistive coating 60 extending axially inside the collector 58 assists in the defocussing. Ceramic elements 56, 57 provide electrically insulating supports for the electrodes of collector 58.

The hollow electron beam gun 12 comprises a cathode 120 which provides the electrons 130 and a focussing electrode 121 which causes the electrons to converge to a thin, hollow beam 13 (10 mil thickness is typical). A second modulating anode 122 also provides focussing of the beam 13 and an acceleration voltage relative to the cathode 120. The cathode 120 is at a high negative potential and the electrodes 121 and 122 are at lesser negative potentials to provide focussing and acceleration, respectively. They are supported by ceramic insulator 123 and magnetically shielded by end walls 27, 28 and support 26 of high permeability material. The cathode 120 and electrodes 121, 122 have circular symmetry with respect to the axis 11, as does the entire structure of the coaxial TWT.

In order to maintain the focussed hollow electron beam 13 throughout the length of the coaxial TWT, an inner and outer periodic permanent magnet (PPM) stack is used. The inner PPM stack 21 comprises alternate disks of permanent magnets 19 alternating with poles 20 comprising disks of high permeability material such as iron. Facing surfaces of adjacent permanent magnets 19 are of the same north or south polarity, so that the flux direction produced by each adjacent magnet 19 is in the opposite direction thereby causing external magnetic field 25 seen by the beam 13 to also alternate in direction as an electron in the beam traverses from the plane of one magnet to the plane of the adjacent magnet. The outer PPM stack 22 comprises permanent magnet disks 23 alternating with poles of high magnetic permeability disks 24. The disks 23, 24 are washer-like in that the disks have a hole having its center in the center of the disk to allow disks 23, 24 to slip over the quartz tube 15 which forms a portion of the outer envelope of the CTWT. The magnets 23 are arranged so that adjacent magnets have alternating north and south pole faces just as the magnets on the inner PPM stack 21. The magnets 19, 23 of the same polarity are arranged to lie in the same plane. The high magnetic permeability disks 20, 24 also are in common planes. The resulting magnetic field produced by the inner and outer PPM stacks 21, 22 are shown by the magnetic field lines 25 to be alternating in direction along the length of the electron beam 13 travel down the length of the CWT. The relative strengths of the magnets of the inner PPM stack 21 and outer PPM stack 22 are such that the magnetic field produced by their combination does not have a radial component passing through the median radius of the electron beam 13 which is centered radially by design between the helices. This condition is characterized as the electron beam being at the adiabatic magnetic boundary. The adiabatic magnetic boundary is a cylindrical surface which coincides as closely as practicable to the cylinder determined by the median radius of the hollow electron beam. The magnetic field lines 25 maintain the electron beam in a highly focussed manner to provide a hollow beam having small radial thickness thereby allowing surrounding structure to be discussed subsequently to be in proximity to the electron beam and thus strongly coupling to the electron beam without at the same time intercepting the electron beam.

The inner PPM stack 21 is contained within the quartz tube 14 and the outer PPM stack 22 surrounds the outer quartz tube 15. Quartz tube 14 is supported by high magnetic permeability support rod 26 which is secured to the electron gun wall 27. Outer quartz tube 15 is secured at one end to wall 28 of electron gun 12. The other end of quartz tube 15 is secured to wall 29 of the depressed collector 58. Inner quartz tube 14 has its other end connected to electrically insulating wall 56 of the depressed collector 58. The connection of the quartz tubes 14, 15 to the electron gun 12 and depressed collector 58 forms a vacuum chamber 31 within the gun 12, the collector 58 and between the tubes 14, 15.

The innermost quartz tube 14 has photolithographically deposited multifilar helical windings 32, the ends of which are terminated in resistive terminations 33, 34 at each end of the windings 32. The exterior of quartz cylinder 15 has a photolithographically deposited input coupling multifilar helix 35 at the cathode end of the CTWT which is connected to a planar center conductor 360 of the planar input waveguide 36 of the tube to which an input signal from a source (not shown) to be amplified is applied when the CTWT is in operation. The collector 58 end of the cylinder 15 has deposited on its exterior surface an output coupling multifilar helix 37 which is connected at its outermost end to the planar center conductor 380 of the planar output waveguide 38. In operation of the CTWT, the output terminal is connected to an external load (not shown). The input coupling helix 35 and the output coupling helix 37 extend longitudinally along the length of the coaxial tube 15 for a length sufficient to couple the energy into and out of, respectively, the multifilar helix 39 which is formed on the inner surface of the cylinder 15. Multifilar helix 39 is terminated at each of its ends with dissipative terminations 40, 41 at its input and output ends, respectively. The radial spacing between helices 32, 39 is preferably less than a wavelength of the signal being amplified for tight coupling of the helices.

For a 35 GHz CTWT, the wires or tapes of the multifilar helices would typically be 6 mil in width and 6 to 7 mil spacing between tapes and of 2 mil thickness with rounded corners of the tapes produced by the lithographic processing of the tapes. There is a minimum of 10 tape starts per turn for effective multifilar helix behavior. The number of helical elements per pitch is chosen to be sufficient to ensure strong fundamental coupling (phase shift per subpitch less than 100 degrees). In this range, computations employing the sheath helix boundaries conditions result in negligible error relative to the tape helix model.

The conductor 360 and waveguide 36 may be in planar circular form as shown in FIG. 1 or some other suitable coupler. An alternative form of coupler would comprise a circular waveguide replacing support 26. The circular waveguide would flare radially outward to form a planar waveguide at the longitudinal location of the end of coupling helix 35 and make electrical connection thereto by a center conductor of the waveguide. A similar waveguide structure would couple to coupling helix 37.

Coupling of rf power to and from the coaxial helix system may be accomplished by any one of several means. For wideband coupling, use of a short length of the coaxial, multifilar helix 35, 37 located on the exterior surface of the dielectric support tube 15 is effective. Power flow in the desired mode may be coupled to the interior helix structures 32, 39 by controlling the helix pitch profile to match that for the interior coupled helix 32, 39 system. Under these velocity-match conditions, power flow transfers cyclically among the individual helices. The coupler length is chosen to optimize the power transfer. Thus, input and output power flow transfer is effected by controlling the individual helix pitch profiles of the three-helix system 35, 32, 39 and 37, 32, 39.

Figure 2:
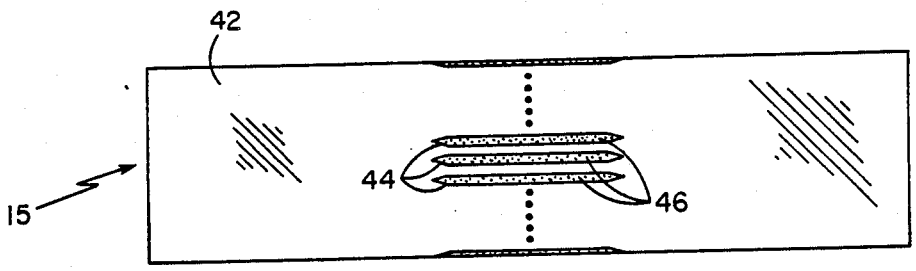
FIG. 2 is a plan view of a cylindrical tube showing energy absorbing regions.

The outer surface of cylindrical tube 15 has in addition to the input and output coils at its respective ends a metallic electrically conductive layer 42 which serves the function of providing favorable wide-band properties resulting from a relatively flat impedance profile as a function of frequency. Cylindrical tube 14 also has a metallic layer 43 on its inner surface which provides the same function. The layers 42, 43 are therefore outside the vacuum region containing the beam 13. In order to suppress undesired modes and to prevent oscillation of the CTWT, the metallic layers 42, 43, which provide the heavy back wall loading contributing to greater bandwidth of the CTWT, are longitudinally slotted by slots 44 shown in the plan view of cylinder 15 in FIG. 2 to have regions near the longitudinal center of the tube where the cylindrical tubes 14, 15 are not covered by the metallic layers 43, 42, respectively. These slots allow some of the rf energy to pass through the tubes to be absorbed by an rf dissipative material 46, such as graphite, which is deposited onto the slotted regions of the walls 14, 15. The slots 44, 45 are tapered in the longitudinal direction to reduce discontinuity effects.

To achieve wide-band properties, the present approach is to interact with the fast-wave, fundamental mode of the contrawound helix system, which supports a strong symmetric TM component between the helices. Low dispersion can be obtained by bringing the metallic terminators on the dielectric helix-support sleeves as closely as practicable to the helices. To minimize loss and to maximize the beam coupling impedance, a low loss, low dielectric constant material such as quartz is selected as the dielectric medium. The sleeves also function as a vacuum wall and provide a natural rf coupling window.

Figure 3:
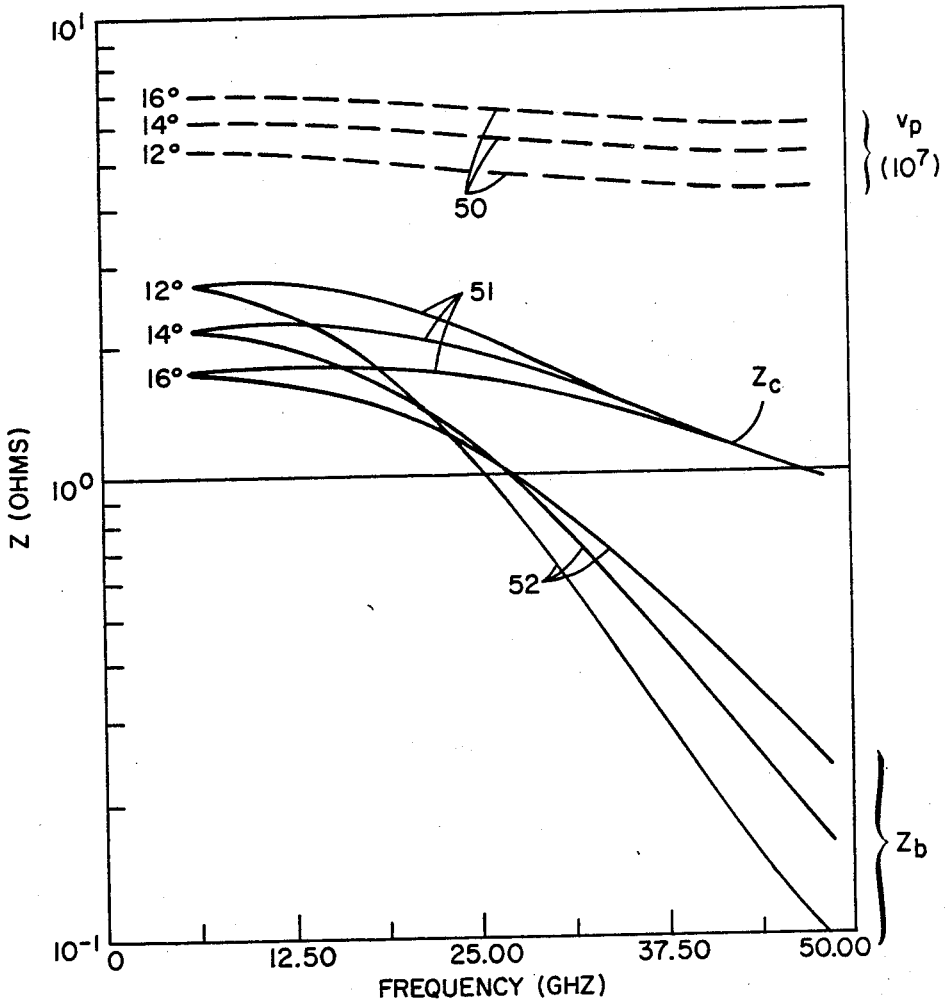
FIG. 3 is a graph of phase velocity and impedance values for different helix pitch angles as a function of frequency.

The phase velocity and beam coupling impedance characteristics of a 600 watt circuit design at 35 GHz employing a 0.5 inch mean beam diameter and a 25-mil gap between helices 32, 39 are shown in FIG. 3. FIG. 3 shows a relatively flat impedance profile, showing to those skilled in the art the effectiveness of the conductive wall in providing favorable wide-band properties. The plots 50 of phase velocity, $V_p$, for three helix winding pitch angles (12°, 14°, and 16°) with respect to the tube axis 11 are substantially flat, and the plots 51 of the impedance coupling $Z_c$, at the slow-wave circuits 32, 39, and the plots 52 of the beam coupling impedance, $Z_b$, for these same pitch angles indicate to one skilled in the art that operation over a wide frequency band centered around 35 GHz is achievable. At large radii suitable for high power applications, the average impedance falls inversely with the radius value to a good approximation; however, the increased beam current sustains the gain level. The multifilar helix system of this invention produces numerous independent propagating modes (four for each sub-helix element pair). Mode interference with backward wave modes are managable since they are of high azimuthal number and have negligible beam coupling impedance at the beam. Band splitting with the fundamental mode can result from non-concentric circuit elements. Thus, reasonable tolerance control should be exercised in order to avoid "power holes" and possible interference at harmonic frequencies. A slightly tapered circuit pitch for windings 39, 32 effectively alleviates the manufacturing problem of obtaining reasonable tolerance control. Although the CTWT has been described with contrawound helices, similarly wound helices will also be operable but with more limited bandwidth of the CTWT.

An alternate embodiment of FIG. 1 has the input coupling helix 35 coupled to the gun 12 end of helix 32 and the output coupling helix 37 coupled to the collector 58 end of helix 32. In this embodiment, the helices 35, 37 are fabricated on the inside of tube 14 instead of on the outside of tube 15 and conductor 43 occupies the region between the helices 35, 37.

In conclusion, in order to achieve high average power in the kilowatt range over wide-band at high frequency (70–100 GHz), the advantages associated with the contrawound, multifilar helix system, interacting with a coaxial, PPM-focussed hollow beam are utilized. The power level capabilities are attributed to the freedom in the selection of the radial dimension of the structure, made possible by the spatial harmonic properties associated with multifilar helix delay lines. Thus, the beam and rf power density levels can be chosen to compare favorably with those for conventional, helix-type, TWT designs at much lower frequencies. Direct benefits to be derived from the coaxial configuration are found in (a) reduced magnetic focussing field requirements, (b) increased thermal dissipation capability between helix conductor elements and dielectric support, (c) natural backwall loading for wide-band interaction, (d) improved depressed-collector efficiency and (e) unique means for rf power coupling and transmission.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A coaxial traveling wave tube comprising:

means for providing a hollow-electron beam;

a first multifilar helical coil means;

means for providing an adiabatic magnetic boundary at said beam;

a second and third multifilar helical coil means external and internal to said beam, respectively, for electromagnetically coupling to said beam;

a fourth multifilar helical coil means;

said first and fourth helical coil means coupling an rf input signal into and an output signal from one of said second or third helical coil means, respectively; and means for supporting said first, second, third and fourth helical coil means, and said magnetic boundary means to form a traveling wave tube.

2. A coaxial traveling wave tube comprising:

an electron gun source providing a hollow-beam of electrons;

a collector for said beam of electrons;

a first and second multifilar helix extending along the interior and exterior, respectively, of said hollow-beam of electrons;

a first and second coaxial periodic permanent magnet stack;

said first stack being interior to and extending along the length of said first helix;

said second stack being exterior to and extending along the length of said second helix;

said first and second periodic permanent magnet stacks providing an adiabatic magnetic boundary for said electron beam;

said first and second helices being multifiler helices; and means for supporting said first and second helix and said first and second stack to form a portion of said traveling wave tube.

3. The tube of claim 2 comprising in addition:

said first and second helices each having an end at said gun source and at said collector;

a third multifilar helix coupled at one end to one of said first and second helices; and a fourth multifilar helix coupled at the other end to said one of said first and second helices.

4. The tube of claim 2 comprising in addition:

said first and second helices being adjacent to said electron beam and having a mean diameter substantially the same as the mean diameter of said beam.

5. The tube of claim 3 comprising in addition:

first and second tubes of different diameter each having a first and second end;

said electron source, collector, and said first and second tube forming a first and second interior surface, respectively, in an evacuated envelope for said electron beam;

said hollow electron beam being between said first and second tubes;

said first and second helices being on the first and second surface;

said third and fourth helices being on an exterior surface of said first tube opposite said first interior surfaces.

6. The tube of claim 5 comprising in addition:

a first electrically conductive film on said first tube exterior surface between said third and fourth helices; and a second electrically conductive film on an exterior surface opposite said interior surface of said second tube.

7. The tube of claim 6 wherein at least one of said first and second electrically conducting films has axially directed slots in the film; and said slots being coated with rf absorbing material.

8. The tube of claim 2 wherein:

said first and second helices are contrawound.

9. The tube of claim 3 wherein:

said first, second, third and fourth helices are each contrawound with respect to its nearest adjacent helix.

10. The tube of claim 2 wherein:

said hollow electron beam substantially coincides with the adiabatic magnetic boundary of said first and second PPM stack.

11. The tub of claim 10 comprising in addition:

said beam has a diameter which substantially coincides with the mean diameter of said first and second helices.

12. A coaxial traveling wave tube comprising:

means for providing a hollow-electron beam;

means for providing an adiabatic magnetic boundary at said beam;

a first and second multifilar helical coil means external and internal to said beam, respectively, for electromagnetically coupling to said beam;

means for coupling an rf input signal into, and an output signal from one of said first and second helical coil means, respectively; and means for supporting said first and second helical coil means and said magnetic boundary means to form a traveling wave tube.

13. The tube of claim 12 comprising in addition:

said first and second helical coil means each having an end at said gun source and an end at said collector;

means for coupling an input RF signal into the end of at least one of said first and second helical coil means at said gun source end; and means for coupling an output RF signal from the end of at least one of said first and second helical coil means at said collector end.

* * * * *